United States Patent [19]

Bottinelli et al.

[11] Patent Number: 4,983,214

[45] Date of Patent: Jan. 8, 1991

[54] METHOD AND APPARATUS FOR DIRECT REDUCTION OF METAL OXIDES

[75] Inventors: N. Edward Bottinelli, Dallas, Tex.; Norman L. Kotraba, Tega Cay, S.C.; Norman G. Bishop, Houston, Tex.

[73] Assignee: Zia Technology, Inc., Dallas, Tex.

[21] Appl. No.: 479,769

[22] Filed: Feb. 13, 1990

[51] Int. Cl.[5] ..... F27B 7/42; C21B 13/08

[52] U.S. Cl. ..... 75/387; 75/479; 266/78; 266/173; 266/158

[58] Field of Search ..... 266/78, 158, 173; 75/387, 414, 419, 961, 474–482

[56] References Cited

U.S. PATENT DOCUMENTS

| | | | |
|---|---|---|---|
| 2,103,131 | 12/1937 | Wolf | 75/419 |
| 2,526,659 | 10/1950 | Harman | 75/475 |
| 3,235,375 | 2/1966 | Meyer et al. | 75/478 |
| 3,652,260 | 3/1972 | Azami | 75/479 |
| 3,831,913 | 8/1974 | Ando et al. | 75/479 |
| 4,389,242 | 6/1983 | Baker | 266/173 |

*Primary Examiner*—Melvyn J. Andrews

*Attorney, Agent, or Firm*—Ralph H. Dougherty

[57] ABSTRACT

A method and apparatus is disclosed for direct reduction of metal oxides, using a rotary kiln, fed with greenball pellets, the kiln having a feed-end and a discharge end. A first chamber within the kiln, and adjacent to the feed-end, is used for drying, preheating and indurating the greenball pellets. Greenball pellets are fed into the first chamber using a conventional mechanism. The feed-end is sealed to prevent egress of process gas from the kiln into the atmosphere and ingress of the atmosphere into the kiln. A first burner is used for drying, preheating and indurating the greenball pellets within the first chamber. A second chamber within the kiln, adjacent to and connected with the first chamber, having a diameter greater than the first chamber, is used for reducing the pellets, the second chamber being adjacent to the discharge end. A second burner may be used for reducing the pellets within the second chamber. Reduced pellets are discharged from the discharge end. The axial angle of the kiln is varied to regulate the flow rate of the greenball pellets from the first chamber to the second chamber.

34 Claims, 5 Drawing Sheets

METHOD AND APPARATUS FOR DIRECT REDUCTION OF METAL OXIDES

BACKGROUND OF THE INVENTION

1. Field of the Invention

The present invention generally relates to pyrometallurgical treatment of ores and, more particularly, is concerned with direct reduction of metal oxides. Specifically, the invention relates direct reduction of iron oxides, in a continuous feed, continuous discharge, variable slope, variable diameter rotary kiln.

2. Description of the Prior Art

Attempts to develop a large-scale direct process for manufacturing iron and steel to compete with indirect processes now in use have included trials of virtually every known type of apparatus suitable for the purpose (e.g., pot, reverberatory, regenerative, shaft, rotary, stationary, retort, electric, and various combination furnaces, and fluidized-bed reactors). A variety of reducing agents also have been tried, such as coal, coke, graphite, char, distillation residues, fuel oil, tar, producer gas, coal gas, water gas and hydrogen.

The present invention relates to a rotary-kiln type of direct reduction operation using greenball pellets. Generally, direct processes can be classified on the basis of whether they use solid reductants or gaseous reductants.

A rotary-kiln type of operation for the reduction of iron ore by gaseous reagents has some inherent disadvantages. Operation with the reducing gases under pressure is impractical, for example. Also, because only a small portion of the total volume in a rotary kiln is occupied by reactant solids, the productive capacity per unit of reactor volume is relatively low. These disadvantages may be partly or wholly offset by the ability of a rotary kiln to handle fine materials, operate at high reducing temperatures (1800° to 2000° F.) without sticking of reduced iron powder, and operate in a truly continuous countercurrent manner.

Previous rotary kiln direct reduction processes which use solid carbonaceous materials as the source of reductants avoid the problems associated with gaseous reductants, but typically encounter problems with the efficient utilization of volatile hydrocarbon gas contained in the carbon source. Also, greenball pellets which contain carbon cannot be pre-indurated in a separate facility without burning out the carbon and causing sintering of the pellets. Previous attempts made by various researchers to indurate pellets in a reducing atmosphere (such as in the ACCAR Process and the SLRN Process) have not been successful. In addition, existing direct reduction processes are designed to consume large volumes of high grade raw materials to produce premium quality products, and cannot easily develop dual oxidizing and reducing atmospheres in the same kiln without over-heating the interface area between the two atmospheres or creating the possibility for an explosive condition. Retention time of process material in existing rotary kiln direct reduction processes is on the order of six to eight hours.

Existing rotary kiln direct reduction processes utilize either a countercurrent or co-current gas-to-solids flow system. Countercurrent flow systems (i.e., burden material moves down slope and process gas moves up-slope) cannot efficiently utilize the methane which is evolved from the burden during the preheating period because the temperature in that zone of the kiln is marginal, generally too low for ignition of the gas. Much of the evolved methane passes out of the kiln unburned and must later be burned in the afterburner, which inefficiently wastes the caloric content of the evolved methane.

In co-current flow systems, burden material and process gas flow in the same down-slope direction. A feed-end burner is required to drive the preheating process. Volatile hydrocarbons, which are evolved from the carbon source in the burden during the preheating process, are entrained in other gases and pulled down-slope toward the discharge end of the kiln, in which area the gas is burned with air, the air being introduced by and through auxiliary air blowers. While the energy released by burning the hydrocarbon gases evolved from the burden can be utilized in the reducing process in the co-current system, the exact area or location of the kiln in which the gases burn is very difficult to control and localized overheating can be very detrimental to the process by encouraging ring building on the interior of the kiln refractory. The lack of control is due to the imperfect nature of the burden material and the inexact control of the mechanical feeding equipment which causes the area of release of the volatile hydrocarbon gases to change minute-by-minute in the kiln, thus constant adjustments of the auxiliary air blower dampers are required in order to maintain constant temperature control in the kiln.

Because of the high cost of land, it is also highly desireable to reduce the capital cost of a rotary kiln direct reduction plant by providing a kiln requiring less land without reducing the capacity of the kiln.

Applicants are unaware of any prior art that accomplishes the objects of the present invention. Consequently, a need exists for a method and apparatus for direct reduction of metal oxides and ores by a continuous feed/continuous discharge furnace and a variable slope/variable diameter short rotary kiln.

SUMMARY OF THE INVENTION

The present invention is an innovative method and apparatus for direct reduction of metal oxides, which overcomes the problems and satisfies the needs previously considered.

A method and apparatus are disclosed for direct reduction of metals, in which a rotary kiln having a feed-end and a discharge end is fed with greenball pellets. In a first chamber within the kiln, adjacent to the feed-end, the greenball pellets are dried, preheated and indurated. Greenball pellets are fed into the first chamber using any desired and suitable conventional feed mechanism. The feed-end is sealed to prevent egress of process gas from the kiln into the atmosphere and ingress of the surrounding atmosphere into the kiln. A burner within the first chamber is provided for drying, preheating and indurating the greenball pellets. The indurated pellets are reduced in a second chamber within the kiln, adjacent to and connected with the first chamber, and having a diameter greater than that of the first chamber, the second chamber being adjacent to the discharge end. An optional second burner may be utilized, if required, to provide additional heat and proper atmosphere for reducing the greenball pellets within the second chamber. Reduced, indurated pellets are removed from the discharge end of the kiln. The axial angle of the kiln is varied to regulate the flow of the pellets from the first chamber to the second chamber.

In summary, the invention encompasses a continuous feed/continuous discharge rotary kiln method for direct reduction of metal oxides and a continuous feed/continuous discharge variable slope/variable diameter short rotary kiln apparatus for direct reduction of oxides and ores.

OBJECTS OF THE INVENTION

The principal object of the present invention is to provide a method for processing low grade, heavy metal contaminated electric arc furnace (EAF) flue dust.

It is another object of this invention to provide a method of removing and recovering the contaminating heavy metals from EAF flue dust and rendering the remaining solid residue non-toxic to the environment.

It is also an object of the invention to provide a rotary kiln apparatus for treating low grade, heavy metal contaminated electric arc furnace flue dust.

Another object of the invention is to provide means for quickly changing the operating slope (axial angle) of a rotary kiln to accommodate temporary or permanent variances which may occur in the quality and/or quantity of EAF flue dust produced by changed operating parameters in the host steel mill.

Another object of the invention is to provide means for varying retention time and bed depth of process material in the invented kiln.

Another object of the invention is to avoid the use of auxiliary axial shell air blowers presently required in existing rotary kiln direct reduction processes.

Another object of the present invention is to provide a rotary kiln with a relatively small exit diameter without causing vacuuming of product material into the gas cleaning system.

A further object of the invention is to provide means for creating a high temperature partially oxidizing atmosphere in the drying and preheating area of the kiln.

Another object of the invention is to provide means for creating either an oxidizing or reducing atmosphere in the reducing/smelting area of the kiln.

Another object of the invention is to provide means to receive and process greenball pellets without prior induration.

Another object of the invention is to provide both co-current and countercurrent control of principal process burners.

Another object of the invention is to provide an invention operable at temperatures well above the melting point of the burden material.

BRIEF DESCRIPTION OF THE DRAWINGS

The foregoing and other objects will become more readily apparent by referring to the following detailed description and the appended drawings in which.

DETAILED DESCRIPTION

Figure 1:
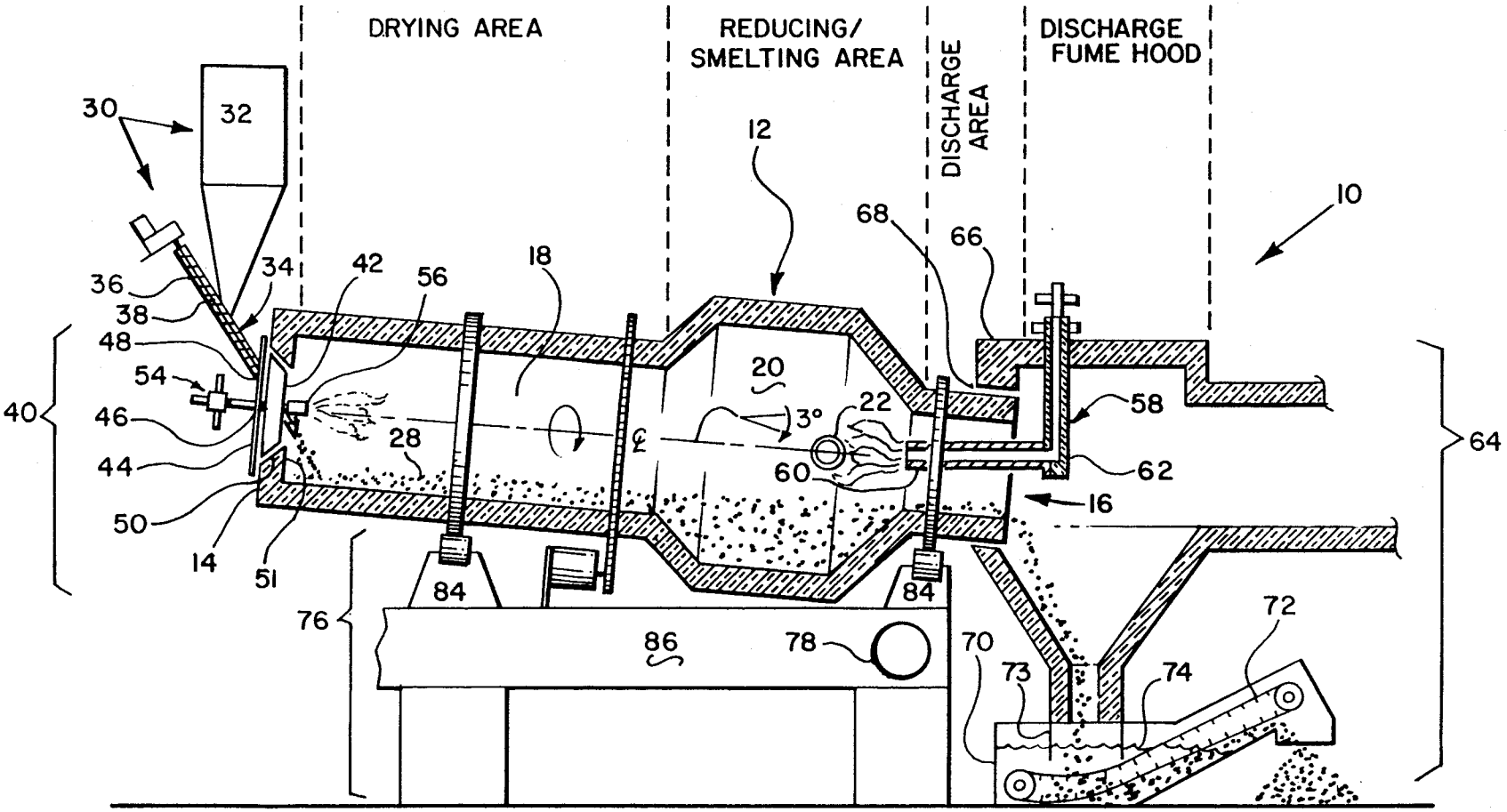
FIG. 1 is a vertical cross section of the apparatus of the invention, along with auxiliary equipment.
Figure 3:
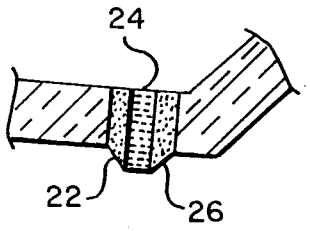
FIG. 3 is an enlarged vertical sectional view of the graphite casting block.
Figure 2:
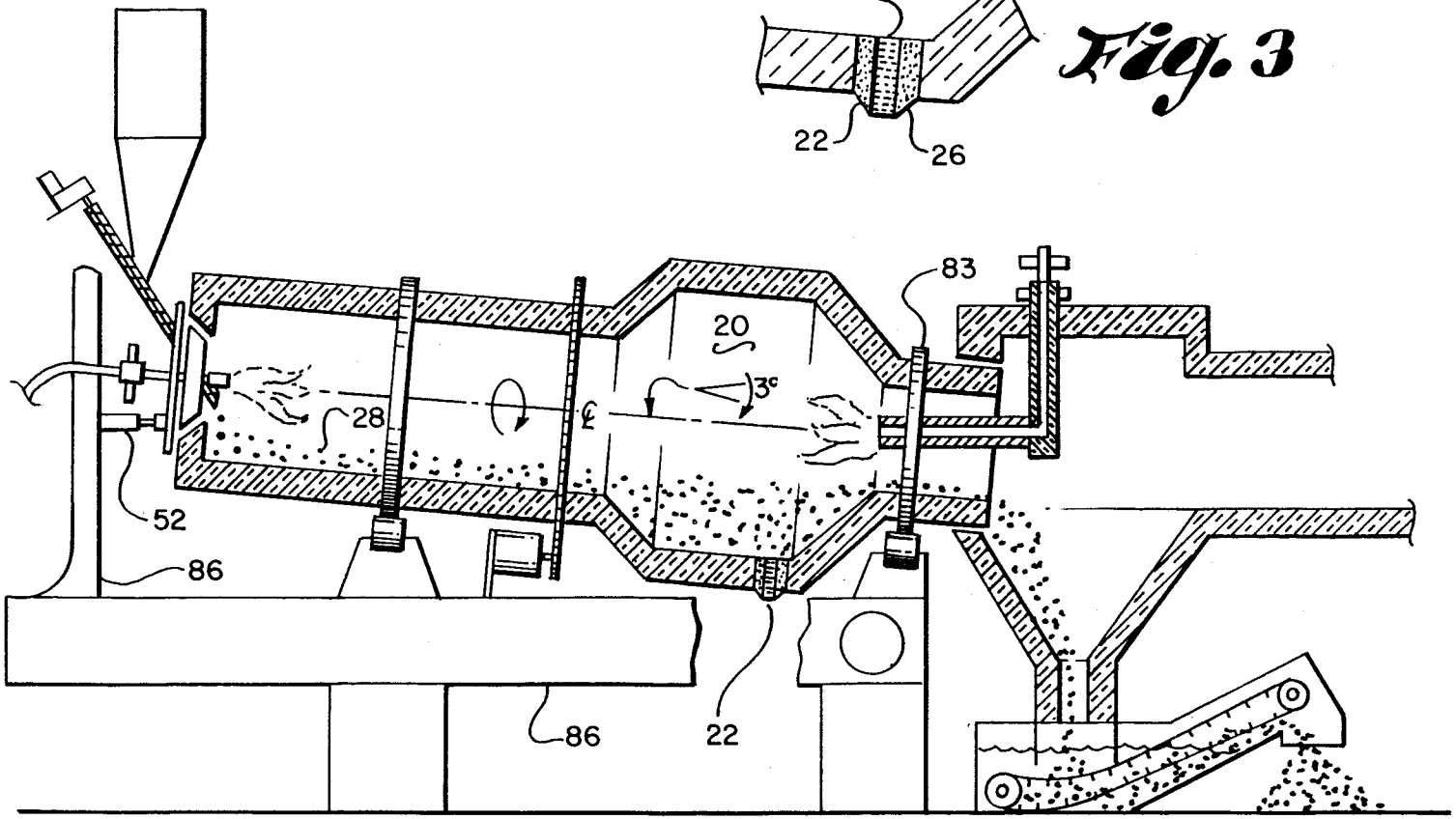
FIG. 2 is a vertical cross section of the apparatus of FIG. 1, with the kiln body rotated to place the casting block in the lower position.
Figure 4:
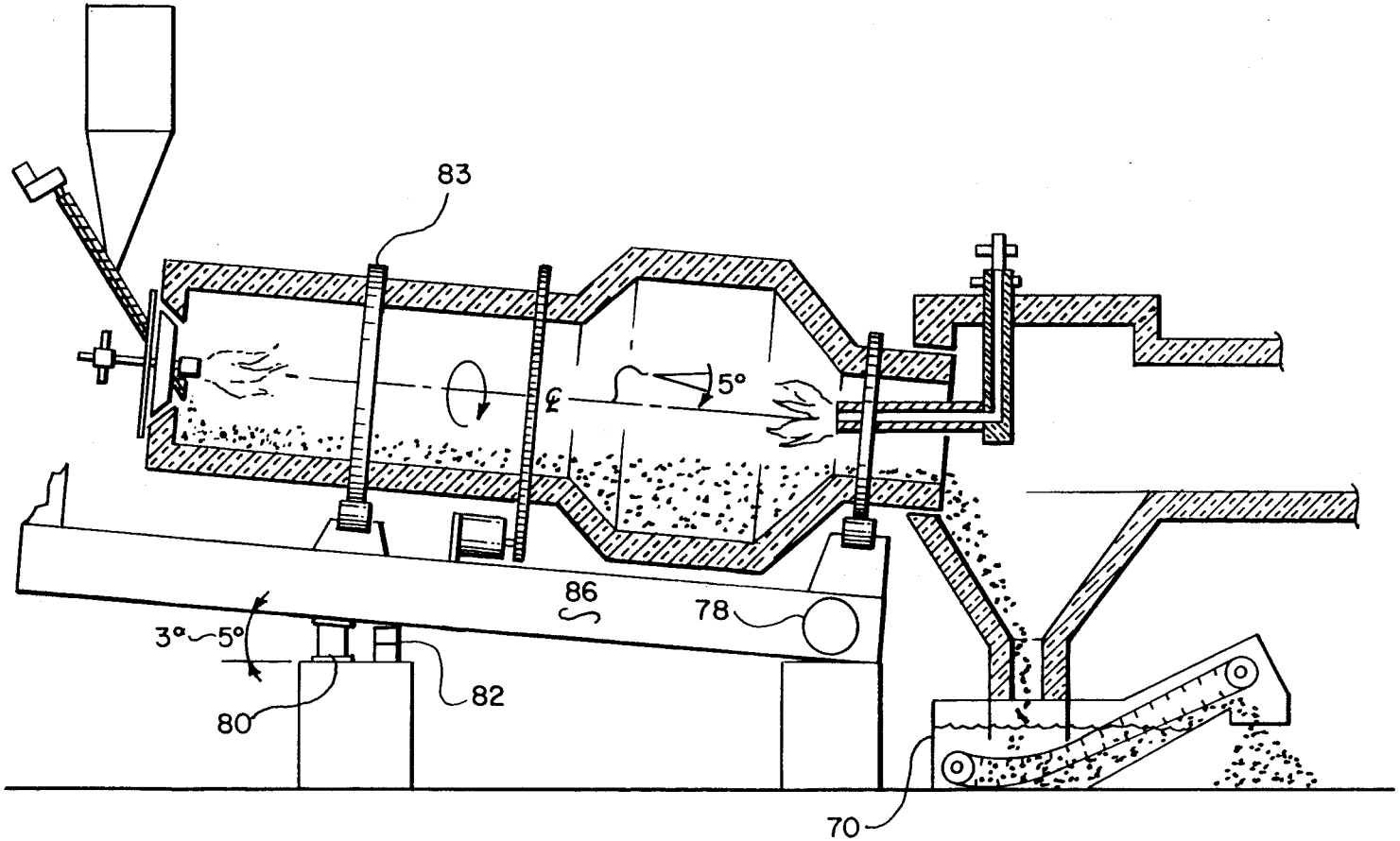
FIG. 4 is a view of the invention shown in FIG. 1, showing a variation in the axial slope of the kiln.

Referring now to the drawings, and more particularly, to FIG. 1, a method and apparatus for direct reduction of metal oxides, generally designated 10, comprises the preferred embodiment of the present invention.

The apparatus 10 for direct reduction includes a rotary kiln 12, fed with greenball pellets 28, which has both a feed-end 14 and a discharge end 16. The short rotary kiln 12 is adapted to directly reduce and/or smelt metal oxides (both ferrous and non-ferrous) in the form of Electric Arc Furnace (EAF) flue dust, which is admixed with one or more solid carbonaceous reductants and formed into greenball pellets 28.

A first chamber 18 within the kiln 12, adjacent to the feed-end 14, is used for drying, preheating and indurating the greenball pellets 28. The feed-end 14 receives the greenball pellets 28 into a drying area, that is, the first chamber 18, and conveys the pellets 28 down slope to the second chamber 20 (reduction/smelting hearth area). The first chamber 18 not only conveys greenball pellets 28 down-slope, but also dries, devolatilizes hydrocarbons, preindurates and ignites the pellets 28 before they reach the reducing/smelting hearth of the kiln, that is, the second chamber 20. The diameter of the first chamber 18 is such that during the conveyance of the greenball pellets 28 from the first chamber 18 to the second chamber 20, and while the kiln 12 is rotating, the depth of the greenball pellets 28 within the first chamber 18 does not exceed the optimum operating depth, which is six inches. Greenball throughput rate in the drying area is controlled at ten to fifteen minutes by varying the feed rate, rate of rotation of the kiln in revolutions per minute (RPM), and angle of kiln slope toward the discharge end 16.

Feeding means 30 for feeding the greenball pellets into the first chamber 18 includes a feed container 32 external to the kiln 12 for holding the greenball pellets 28, and means 34 for conveying the greenball pellets 28 from within the feed container 32 to the feed-end 14 and into the first chamber 18. The feed container 32 contains a level of greenball pellets 28 sufficient to prevent egress of process gas from the kiln 12 into the atmosphere and ingress of the atmosphere into the kiln 12. The conveying means 34 includes a gas seal screw conveyor 36 adapted for maintaining a gas seal between the feed container 32 and the first chamber 18 by maintaining the screw conveyor 36 full of greenball pellets 28. The gas seal screw conveyor 36 is adapted for preventing the greenball pellets 28 from being compressed by the rotation of the screw conveyor 36. The gas seal screw conveyor 36 also has screw flights 38 adapted for preventing the free flow of the greenball pellets 28 from the feed container 32 into the first chamber 18. The screw conveyor 36 is also adapted for delivering the green ball pellets 28 into the first chamber 18 by varying the speed and angle of delivery.

Sealing means 40 for sealing the feed-end 14 and preventing egress of process gas from the kiln 12 into the atmosphere and ingress of the surrounding atmosphere into the kiln 12 includes a feed-end gas seal block 42, a feed-end seal block receiving orifice 50, and one or more seal block holding devices 52, such as air jacks, positioned around the backing plate. The gas seal block 42 is constructed of a tapered, solid, wear-resistant refractory, such as graphite, and has an insulated steel backing plate 44 for fixed support. The opening 50 in the feed end 14 of the kiln is tapered to mate with the refractory seal. The backing plate and the refractory seal block are provided with mating orifices for receiving the feed screw and the burner. The drying, preheating and indurating means 54 is inserted into a first aperture 46 in the feed-end 14. The conveying means 34 is inserted into a second aperture 48 in the feed-end 14, at an angle between thirty and fifty-five degrees from horizontal. The feed-end receiving portion 50 is integral with and connected to the feed-end 14 and has an opening 51 adapted for receiving the feed-end gas seal block 42 and forming a seal. The air jacks 52 are connected to the support frame 86 and to the steel backing plate 44 for pressing the feed-end gas seal block 42 into the feed-end receiving portion 50, so that a seal is formed. Preferably, the feed-end gas seal block 42 is circular and has a convexly shaped edge. The feed-end receiving portion 50 defines a circular opening 51 having a concavely shaped edge, such that the convex edge of the feed-end gas seal block 42 forms a seal when in contact with the concave edge of the feed-end receiving portion 50. As the refractory seal block 42 wears from the effects of friction during rotation of the kiln, the air jacks press the backing plate and refractory seal block further into the receiving portion 50, until it eventually becomes necessary to replace the gas seal block 42 in order to maintain the gas seal.

Means 54 for drying, preheating and indurating the greenball pellets 28 within the first chamber 18 includes a first process burner 56 for injecting an oxygen and fuel mix into the first chamber 16. The first burner 56 is inserted into and communicates with the sealing means 40 such that the oxygen and fuel mix is injected along the centerline of the kiln 12. The drying, preheating and indurating means 54 is adapted for heating the greenball pellets 28 within the first chamber 18 to a temperature of approximately 900° C.

A second chamber 20 within the kiln, adjacent to and connected with the first chamber 18, having a diameter greater than the first chamber 18, for reducing the greenball pellets 28, the second chamber 20 being adjacent to the discharge end 16. Optionally, the second chamber 20 has a graphite casting block 22 for preventing the passage of solid or liquid material from the second chamber 20. The casting block defines an opening 24 that is normally filled with a carbonaceous plastic clay plug 26, but which may be removed to allow material to be withdrawn from the second chamber 20. The length and diameter of the second chamber 20 is such that during the reduction of the greenball pellets 28 within the second chamber 20, the volume of the greenball pellets 28 within the second chamber 20 is approximately eighty percent of the total weight of all greenball pellets 28 within the kiln 12.

Reducing means 58 for reducing the greenball pellets 28 within the second chamber 20 includes an optional second process burner 60 for injecting an oxygen, air, and fuel mix into the second chamber 20. The second burner 20 is installed in and communicates with the discharging means 64 such that the oxygen, air, and fuel mix is injected along the centerline of the kiln 12. The second process burner 20 is water cooled and covered by refractory 62 to protect the burner 20 from the highly corrosive atmosphere of the hot waste gases exiting the kiln 12. The refractory 62 is made of low K factor (thermal conductivity) material for keeping the exposed surface of the second burner 20 hot and for preventing the premature condensation of heavy metals from occurring on the exterior of the second burner 20.

Discharging means 64 for discharging the greenball pellets 28 from the discharge end 16 includes a fume hood 66, a cooling air inlet gap 68, and a solid product-residue cooling and discharge sump 70. The length and diameter of the discharge area accomplishes two functions relative to the passage of finished solid product or residue (i.e., pellets, and/or slag): first, to quickly convey the material from the second chamber 20 to the discharge end 16; and second, to serve as a dam for retaining the bed depth desired in the second chamber 20.

The fume hood 66 is adapted for maintaining negative pressure inside the fume hood 66, receiving the discharge of the greenball pellets 28 exiting the kiln 12, providing partial afterburning of the process gas exiting from the kiln 12, and conveying the greenball pellets 28 to the cooling sump 70. By maintaining a negative pressure inside the discharge fume hood 66 atmospheric air is induced to flow through the gap 68 between the fume hood 66 and the kiln 12, thus avoiding the need to use a face-to-face dynamic slip seal on the discharge end 16. The velocity of the hot waste gas exiting the kiln 12 decreases while passing through the hood 66, allowing heavy dust particles to settle out of the gas stream and to be collected in the cooling sump 70 with the solid products form the kiln 12.

The cooling air inlet gap 68 is adapted for allowing the intake of a sufficient flow of atmospheric air to provide cooling of the kiln 12 on the discharge end 16 and to initiate afterburning of process gas. The solid product/residue cooling and discharge sump 70 is adapted for receiving material from the discharge end 16 and cooling the material. The cooling air inlet gap 68 between the fume hood 66 and the kiln 12 is sufficient to allow the feed-end 14 to be raised up to five (5° ) degrees relative to the discharge end 16. The discharge end 16 projects into the fume hood 66 approximately one foot, creating a space of approximately one half inch between the exterior steel wall of the kiln 12 and the fixed wall of the fume hood 66. The solid product-/residue cooling and discharge sump 70 includes a conveyor or drag chain 72 for removing material from the sump 70, and a circulating reservoir of water 74 within the sump 70 for cooling material. Product discharge tube 73 extends beneath the surface of the water to provide a gas seal between the fume hood 66 and the sump 70. The sump 70 receives hot product or residue material from the discharge end 16 and cools the material in the water bath 74. Cool water is added to the sump 70 to keep the water in the sump 70 below the boiling point, and excess water is cycled to evaporative cooling.

Varying means 76 for varying the axial angle of the kiln 12 and regulating the flow of the greenball pellets 28 from the first chamber 18 to the second chamber 20 includes a kiln variable-slope axle 78 for allowing the feed-end 14 to be varied as much as five degrees relative to the discharge end 16. Changing the kiln slope is intended to accommodate changes in process material throughput rate in order to allow one furnace installation to be able to process a variety of grades and tonnages of ferrous and non-ferrous oxides. Hydraulic jacks 80 are also included for raising the feed-end 14 to a desired angle. Steel blocks 82 are inserted under the kiln 12 for preserving the selected angle. Riding-ring support roller housings 84 attach to a common steel support frame 86 through which the axle 78 is installed. The length of the discharge area is sufficient to accommodate the installation of the discharge-end kiln support riding-rings 83 and to extend approximately one foot into the discharge fume hood 66.

OPERATION

Figure 5:
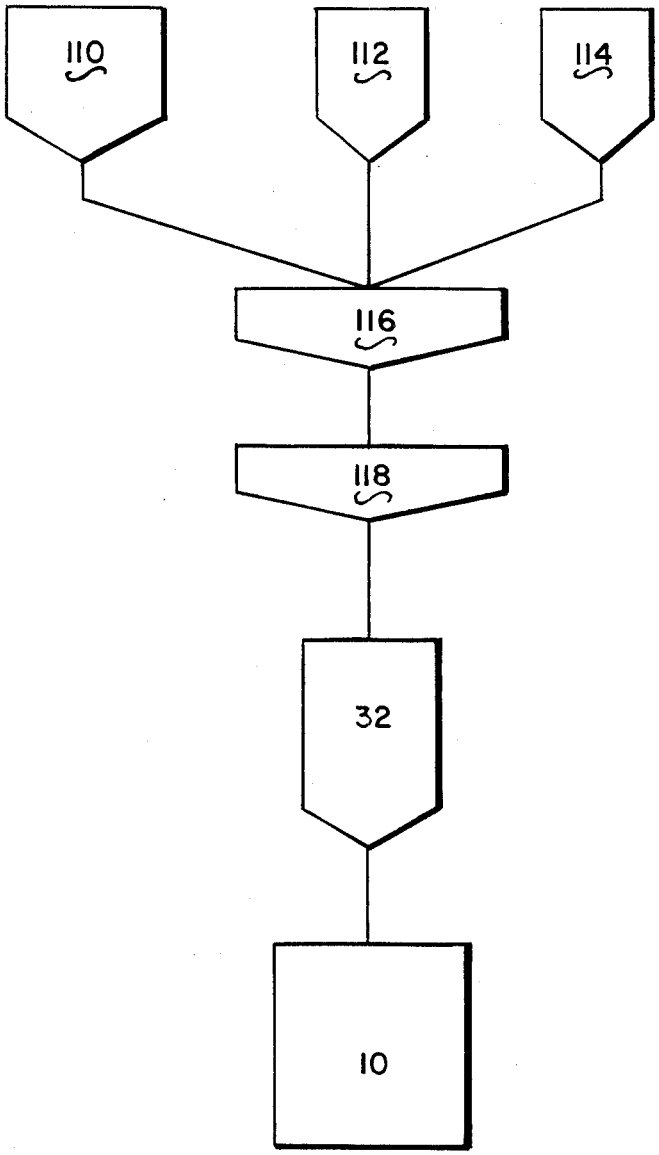
FIG. 5 is a schematic diagram of a method for direct reduction of metal oxides utilizing the rotary kiln apparatus of the invention.
Figure 6:
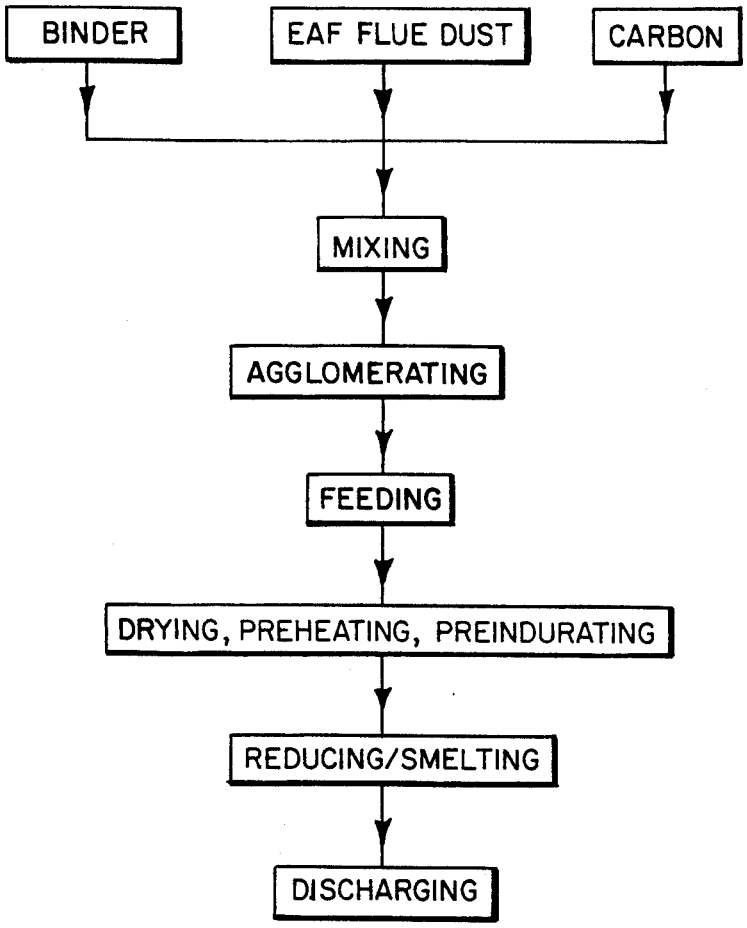

The variable slope/diameter short rotary kiln 12 directly reduces oxides of both ferrous and non-ferrous metals for the purpose of removing contaminating heavy metals from EAF flue dust and recovering recyclable iron and flux materials in either liquid or solid form. A schematic diagram of the method for direct reduction of metal oxides (preferably iron oxides) is shown in FIG. 5, wherein electric arc furnace flue dust from bin 110 and carbon in particulate form from bin 112, along with a tinder or other desired material from bin 114, are fed to a mixer 116 wherein the materials are thoroughly mixed. The mixture is agglomerated in a pelletizer or other agglomerating apparatus to form greenball pellets, which are then placed in a feed container 32 as shown in FIG. 1.

Vaporized heavy metals are reoxidized in the off-gas afterburning system and recovered in the gas scrubbing system as highly concentrated but contaminated zinc oxide secondary flue dust. Secondary treatment of the recovered secondary zinc oxide flue dust is necessary to recover pure zinc and lead metals.

The kiln 12 processes greenball pellets 28 made of EAF flue dust admixed with carbonaceous reducing agents in an efficient manner to accomplish the desired reduction of the oxide material. Admixing of the extremely fine particles of EAF flue dust with pulverized carbon brings the oxides and carbon into intimate contact within the pellet 28. The close association of the oxides and the carbon in a high temperature atmosphere results in very rapid reduction of the oxides. The processing time normally associated with solid carbon reduction processes is significantly decreased.

Existing rotary kiln direct reduction processes are unable to utilize greenball pellets 28 because such pellets do not have sufficient strength to withstand the physical strain induced by the rotating action in a deep bed situation normally associated with such processes. Pellets 28 must first be indurated (heat hardened) in order to achieve sufficient pellet 28 strength to withstand the rigors of deep bed rotation.

In operation, greenball pellets 28 are fed into the first chamber 18. The feed-end 14 is sealed to prevent egress of process gas from the kiln 12 into the atmosphere and ingress of the atmosphere into the kiln 12. Drying, preheating and indurating the greenball pellets 28 occurs within the first chamber 18. Reducing and/or smelting of greenball pellets 28 occurs within the second chamber 20. After reduction and/or smelting takes place, the reduced pellets 28 are discharged from the discharge end 16. The axial angle of the kiln 12 is varied in order to regulate the flow of the greenball pellets 28 from the first chamber 18 to the second chamber 20. The feed rate, rate of kiln revolution (RPM), and angle of kiln slope toward discharge end 14 are varied in order to control the throughput rate of the greenball pellets 28 in the first chamber 18. These parameters are continuously monitored, and are generally changed at periodic intervals, as required for accurate process control.

Pellet induration processes utilize high temperature oxidizing atmospheres to achieve high pellet strength. The high temperature is well above the carbon ignition point. Carbon contained in greenball pellets would ignite in such an atmosphere, the pellet bed would be sintered into a solid mass, and the carbon would be consumed.

This invention allows the efficient use of carbon admixed greenball pellets 28 by providing an oxidizing atmosphere in the first chamber 18 and a reducing atmosphere in the second chamber 20. Induration of the pellets occurs before the pellets reach the deep bed area of the kiln 12.

In the first chamber 18, moisture and volatile hydrocarbon contained in the admixed carbon source are eliminated from the pellet 28 and the gases move down slope toward the second chamber 20. The atmosphere in the first chamber 18 varies gradually from oxidizing near the feed-end 14 to partially reducing by the time the gas reaches the second chamber 20. The greenball pellets 28 are dried, hardened, and preheated to approximately 900° C. in the first chamber 18.

When the pellets 28 reach the second chamber 20, the overbed atmosphere is changed to slightly reducing and the discharge-end 16 second process burner 60 is operated with a mixture of oxygen/air/natural gas to achieve the necessary control rate. Hydrocarbon gas evolved from the greenball pellets 28 can amount to as much as seventy-five percent of the total gas (methane) needed to provide the high temperature energy needed to complete the direct reduction process. The rank of the coal used as the reductant determines how much methane gas will evolve from the greenball pellet 28.

The amount of air blended with oxygen in the discharge-end 16 second process burner 60 is dependent on the energy and flame temperature needed to drive or maintain the process temperature in that area and depending on whether or not melting of the burden is the goal. The velocity of the exit gas through the discharge end 16 of the kiln 12 will also determine how much air can be used without creating excess loss of solid material to the gas cleaning system. Refractories in the second chamber 20 are capable of containing molten iron and slag. The kiln 12 can be operated efficiently below the melting point of the burden material to produce solid slag, directly reduced iron pellets or slag like material. Positive control of the processing temperature is easily managed by the two oxygen/fuel process burners 56, 60. Throughput capacity of the invention is estimated to be in the range of six tons of feed material per hour.

SUMMARY OF THE ACHIEVEMENTS OF THE OBJECTS OF THE INVENTION

From the foregoing, it is readily apparent that we have invented an improved method and apparatus for direct reduction of metal oxides that processes low grade contaminated (by heavy metals) EAF flue dust for the purpose of removing and recovering the contaminating heavy metals and rendering the remaining solid residue non-toxic to the environment, provides means for quickly changing the operating slope (axial angle) of the kiln to accommodate temporary or permanent variances which may occur in the quality and/or quantity of EAF flue dust produced by changed operating parameters in the host steel mill, and provides means for varying retention time and bed depth of process material in the invention kiln. In addition, the invention avoids the use of auxiliary axial shell air blowers used in existing rotary kiln direct reduction processes, provides a kiln with a relatively small exit diameter without causing vacuuming product material into the gas cleaning system, provides a high temperature partially oxidizing atmosphere in the drying and preheating area of the kiln, provides either an oxidizing or reducing atmosphere in the reducing/smelting area of the kiln. The invention also receives and processes greenball pellets without prior induration, provides both co-current and countercurrent control of principal process burners, processes low grade contaminated (heavy metals) EAF flue dust for the purpose of removing and recovering the contaminating heavy metals and rendering the remaining solid residue non-toxic to the environment, and provides an invention operable at temperatures well above the melting point of the burden material.

It is to be understood that the foregoing description and specific embodiments are merely illustrative of the best mode of the invention and the principles thereof, and that various modifications and additions may be made to the device by those skilled in the art, without departing from the spirit and scope of this invention, which is therefore understood to be limited only by the scope of the appended claims.

We claim:

1. Apparatus for direct reduction of metal oxides, using a rotary kiln, fed with greenball pellets, said kiln having a feed-end and a discharge end, and comprising:

(a) a first chamber within said kiln, adjacent to said feed-end, for drying, preheating and indurating said greenball pellets;

(b) means for feeding said greenball pellets into said first chamber;

(c) means for sealing said feed-end and preventing egress of process gas from said kiln into the atmosphere and ingress of the atmosphere into said kiln;

(d) means for drying, preheating and indurating said greenball pellets within said first chamber;

(e) a second chamber within said kiln, adjacent to and connected with said first chamber, having a diameter greater than said first chamber, for reducing said pellets, said second chamber being adjacent to said discharge end;

(f) means for reducing said pellets within said second chamber;

(g) means for discharging said reduced pellets from said discharge end; and (h) means, including a support frame, for varying the axial angle of said kiln and regulating the flow of said pellets from said first chamber to said second chamber.

2. The direct reduction apparatus of claim 1, wherein the diameter of said first chamber is such that during the conveyance of said greenball pellets from said first chamber to said second chamber, and while said kiln is rotating, the maximum depth of said greenball pellets within said first chamber is six inches.

3. The direct reduction apparatus of claim 1, wherein said feeding means includes a feed container external to said kiln for holding said greenball pellets, and means for conveying said greenball pellets from said feed container to said feed-end and into said first chamber.

4. The direct reduction apparatus of claim 3, wherein said feed container is adapted to hold greenball pellets to a level sufficient to prevent egress of process gas from said kiln into the atmosphere and ingress of the atmosphere into said kiln.

5. The direct reduction apparatus of claim 3, wherein said conveying means includes a gas seal screw conveyor adapted for maintaining a gas seal between said feed container and said first chamber.

6. The direct reduction apparatus of claim 5, further comprising said gas seal screw conveyor having screw flights adapted for preventing the free flow of greenball pellets from said feed container into said first chamber.

7. The direct reduction apparatus of claim 5, wherein said gas seal screw conveyor has associated controls for varying the speed of operation and the angle of orientation of the screw conveyor with regard to said first chamber.

8. The direct reduction apparatus of claim 1, wherein said sealing means includes:

(a) a tapered refractory feed-end gas seal block;

(b) an steel backing plate in pressing relation to the exterior of said gas seal block for providing fixed support;

(c) a first aperture in said gas seal block for receiving said drying, preheating and indurating means therethrough into said feed-end;

(d) a second aperture in said gas seal block, at an angle between thirty and fifty-five degree from horizontal, for receiving said conveying means therethrough into said feed-end;

(e) a feed-end receiving portion integral with and connected to said feed-end, having an opening adapted for receiving said feed-end gas seal block and forming a seal therewith; and (f) means connected to said steel backing plate for pressing said feed-end gas seal block into said feed-end receiving portion and forming a seal.

9. The direct reduction apparatus of claim 8, wherein said gas seal block is graphite.

10. The direct reduction apparatus of claim 8, wherein said steel backing plate is insulated.

11. The direct reduction apparatus of claim 8, wherein said means connected to said steel backing plate for pressing said feed-end gas seal forward is a plurality of air jacks connected to said support frame.

12. The direct reduction apparatus of claim 8, wherein said feed-end gas seal is circular, having a convexly shaped edge, and said feed-end receiving portion defines a circular opening having a concavely shaped edge, such that the convex edge of said feed-end gas seal forms a seal when in contact with the concave edge of said feed-end receiving portion.

13. The direct reduction apparatus of claim 1, wherein said drying, preheating and indurating means includes a first process burner for injecting an oxygen and fuel mix into said first chamber, said first burner inserted into and in communication with said sealing means such that said oxygen and fuel mix is capable of injection along the centerline of said kiln.

14. The direct reduction apparatus of claim 13, wherein said drying, preheating and indurating means is adapted for heating said greenball pellets within said first chamber to a temperature of approximately 900° C.

15. The direct reduction apparatus of claim 1, further comprising said second chamber having a graphite casting block for preventing the passage of solid or liquid material from said second chamber, said casting block defining an opening fillable with a carbonaceous plastic clay plug.

16. The direct reduction apparatus of claim 1, wherein said reducing means includes a second process burner for injecting an oxygen, air, and fuel mix into said second chamber, said second burner in communication with said discharging means such that said oxygen, air, and fuel mix is capable of injection along the centerline of said kiln.

17. The direct reduction apparatus of claim 16, wherein said second process burner is water cooled and covered by refractory to protect said burner from the highly corrosive atmosphere of the hot waste gases exiting said kiln.

18. The direct reduction apparatus of claim 17, wherein the refractory is made of low thermal conductivity material for keeping the exposed surface of said second burner hot and for preventing the premature condensation of heavy metals from occurring on the exterior of said second burner.

19. The direct reduction apparatus of claim 1, wherein the length and diameter of said second chamber is such that during the reduction of said pellets within said second chamber, the volume of said pellets within said second chamber is approximately eighty percent of the total weight of all pellets within said kiln.

20. The direct reduction apparatus of claim 1, wherein said discharging means includes a fume hood, a cooling air inlet gap, and a solid product/residue cooling and discharge sump:

(a) said fume hood adapted for maintaining negative pressure inside said fume hood, receiving the discharge of said pellets exiting said kiln, providing partial afterburning of the process gas exiting from said kiln, and conveying said pellets to said cooling sump;

(b) said cooling air inlet gap adapted for allowing the intake of a sufficient flow of atmospheric air to provide cooling of said kiln on said discharge end and to initiate afterburning of process gas; and (c) said solid product/residue cooling and discharge sump adapted for receiving material from said discharge end and cooling the material.

21. The direct reduction apparatus of claim 20, wherein said cooling air inlet gap between said fume hood and said kiln is sufficient to allow said feed-end to be raised or lowered up to 5 degrees relative to said discharge end.

22. The direct reduction apparatus of claim 20, wherein said discharge end projects into said fume hood by approximately one foot, creating a space of approximately one half inch between the exterior steel wall of said kiln and the fixed wall of said fume hood.

23. The direct reduction apparatus of claim 20, wherein said solid product/residue cooling and discharge sump includes means communicating therewith for removing material from said sump, and a circulating reservoir of water within said sump for cooling material therein.

24. The direct reduction apparatus of claim 20, further comprising kiln solid product/residue discharge means extending into said sump beneath the surface of the water therein, and providing a gas seal between said fume hood and said sump.

25. The direct reduction apparatus of claim 23, wherein said means for removing material from said sump is a conveyor.

26. The direct reduction apparatus of claim 23, wherein said means for removing material from said sump is a drag chain.

27. The direct reduction apparatus of claim 1, wherein said axial angle varying means includes a kiln variable-slope axle for allowing said feed-end to vary up to five degrees of slope relative to said discharge end.

28. The direct reduction apparatus of claim 27 wherein said axial angle varying means includes means for raising said feed-end to a desired angle, and means for maintaining said angle.

29. The direct reduction apparatus of claim 27 wherein said means for maintaining said angle are steel blocks inserted beneath said support frame for preserving said angle.

30. The direct reduction apparatus of claim 27 wherein said means for raising said feed-end to a desired angle is a hydraulic jack.

31. The direct reduction apparatus of claim 27 wherein said varying means includes riding-ring support roller housings attached to a common steel frame through which an axle is installed.

32. Apparatus for direct reduction of metal oxides, using a rotary kiln, fed with greenball pellets, said kiln having a feed-end and a discharge end, comprising:

(a) a first chamber within said kiln, adjacent to said feed-end, for drying, preheating and indurating said greenball pellets;

(b) means for feeding said greenball pellets into said first chamber;

(c) means for sealing said feed-end and preventing egress of process gas from said kiln into the atmosphere and ingress of the atmosphere into said kiln;

(d) means for drying, preheating and indurating said greenball pellets within said first chamber;

(e) a second chamber within said kiln, adjacent to and connected with said first chamber, having a diameter greater than said first chamber, for reducing and smelting said pellets, said second chamber being adjacent to said discharge end;

(f) means for reducing and smelting said pellets within said second chamber;

(g) means for discharging said reduced pellets from said discharge end;

(h) means for varying the axial angle of said kiln and regulating the flow of said greenball pellets from said first chamber to said second chamber.

33. A method for direct reduction of metal oxides, using a rotary kiln, fed with greenball pellets, containing metal oxide and a reductant the kiln having a feed-end, a discharge end, a first chamber within the kiln, adjacent to the feed-end, for drying, preheating and indurating the greenball pellets, and a second chamber within the kiln, adjacent to and connected with the first chamber, having a diameter greater than the first chamber, for reducing and smelting the pellets, the second chamber being adjacent to the discharge end, comprising the steps of:

(a) feeding greenball pellets into the first chamber;

(b) sealing the feed-end and preventing egress of process gas from the kiln into the atmosphere and ingress of the atmosphere into the kiln;

(c) drying, preheating and indurating the greenball pellets within the first chamber;

(d) reducing and smelting the greenball pellets within the second chamber;

(e) discharging the reduced pellets from the discharge end; and (f) varying the axial angle of the kiln and regulating the flow of the greenball pellets from the first chamber to the second chamber.

34. The direct reduction method of claim 35, further comprising the steps of varying the feed rate, rate of kiln rotation, and angle of kiln slope toward the discharge end, thereby controlling the throughput rate of the greenball pellets in the first chamber.

* * * * *